US008944706B2

(12) United States Patent
Sakamoto et al.

(10) Patent No.: US 8,944,706 B2
(45) Date of Patent: Feb. 3, 2015

(54) PRINTER, PRINTING SYSTEM AND PRINTING METHOD

(75) Inventors: Takashi Sakamoto, Kyoto (JP); Toshio Maeda, Kyoto (JP); Hiroshi Tomiya, Kyoto (JP)

(73) Assignee: SCREEN Holdings Co., Ltd. (JP)

( * ) Notice: Subject to any disclaimer, the term of this patent is extended or adjusted under 35 U.S.C. 154(b) by 595 days.

(21) Appl. No.: 12/730,599

(22) Filed: Mar. 24, 2010

(65) Prior Publication Data

US 2010/0247218 A1 Sep. 30, 2010

(30) Foreign Application Priority Data

Mar. 27, 2009 (JP) ..... P2009-79814

(51) Int. Cl.
*B41J 3/60* (2006.01)
*B41J 11/46* (2006.01)

(52) U.S. Cl.
CPC ... *B41J 3/60* (2013.01); *B41J 11/46* (2013.01)
USPC ..... 400/188; 400/583; 400/583.3; 400/611; 347/221

(58) Field of Classification Search
USPC ..... 271/9.1; 101/93.11; 400/188, 578, 579, 400/583, 583.3, 611; 399/384, 388, 394, 399/395, 401; 347/221
See application file for complete search history.

(56) References Cited

U.S. PATENT DOCUMENTS

| | | | | |
|---|---|---|---|---|
| 4,731,542 A | | 3/1988 | Doggett | |
| 4,965,597 A | | 10/1990 | Ohigashi et al. | |
| 5,160,946 A | | 11/1992 | Hwang | |
| 5,704,282 A | * | 1/1998 | Khalid | 101/93.01 |
| 6,499,397 B2 | * | 12/2002 | Stern | 101/248 |
| 6,763,220 B2 | * | 7/2004 | Nakazawa | 399/401 |
| 2004/0240919 A1 | | 12/2004 | Hisatomi | |

FOREIGN PATENT DOCUMENTS

| | | |
|---|---|---|
| DE | 198 40 301 | 3/2000 |
| GB | 2 232 320 | 12/1990 |
| JP | 62-59975 | 3/1987 |
| JP | 63-50874 | 3/1988 |
| JP | 5-11559 | 1/1993 |
| JP | 05-035037 | 2/1993 |
| JP | 8-272176 | 10/1996 |

(Continued)

OTHER PUBLICATIONS

European Search Report issued Aug. 10, 2010 in connection with corresponding European Patent Application No. 10 002 532.9.

*Primary Examiner* — Matthew G Marini
(74) *Attorney, Agent, or Firm* — Ostrolenk Faber LLP

(57) ABSTRACT

The first image which is a continuous image divided into pages is printed on the first surface of web by the first printer, and the start mark is printed at the head of each page. The second image which is a continuous image is printed on the second surface by the second printer in synchronization with recording synchronization pulses. In printing of the second image, obtained is a difference between the number of pulses inputted to the second printing mechanism between detections of preceding and succeeding start marks, and the number of pulses estimated to be inputted thereto in the case where expansion or shrinkage of web doesn't occur, to adjust the frequency of pulses on the basis of the difference. Therefore, the second image is printed in accordance with the first image on the web without being affected by expansion or shrinkage of web.

6 Claims, 8 Drawing Sheets

(56) References Cited

FOREIGN PATENT DOCUMENTS

| | | |
|---|---|---|
| JP | 11-231580 | 8/1999 |
| JP | 2003-66811 | 3/2003 |
| JP | WO03/019348 | 3/2003 |
| JP | 2003-316208 | 11/2003 |
| JP | 2004-243654 | 9/2004 |
| JP | 2005-22241 | 1/2005 |
| JP | 2005-96081 | 4/2005 |
| JP | 2007-206630 | 8/2007 |

* cited by examiner

PRINTER, PRINTING SYSTEM AND PRINTING METHOD

TECHNICAL FIELD

The present invention relates to a technique of printing a continuous image on a web without a printing plate in accordance with a printed image formed on the web.

BACKGROUND ART

In an inkjet printer, an electrophotographic printer and the like, printing is performed on a web which is a band-like printing medium, and images are printed for respective pages which are set at regular intervals in a direction where the web extends. In the printer, since it is necessary to heat the web in order to dry ink on the web or fix toner on the web, expansion or shrinkage of the web occurs. Thus, for example, in the case where images are printed on one surface (hereinafter, referred to as a "first surface") of the web and then images are printed on the other surface (hereinafter, referred to as a "second surface") such as double side printing, an image of each page can not be printed at a predetermined position on the second surface appropriately. Furthermore when double side printing is performed by two printers, an image can not be printed appropriately at a predetermined position on the second surface even by a slight difference of structures of the printers.

A printing system where images are printed on both surfaces of a web by two printers is disclosed in Japanese Patent Application Laid-Open No. 2004-243654 (Document 1), alignment marks are printed at the heads (tops) of respective pages when images are printed on a first surface of the web by a first printer, and respective alignment marks are detected by a mark sensor when images are printed on a second surface by a second printer. In the printing system, a feeding speed of the web is controlled on the basis of detection timing in the mark sensor, to prevent displacement of each image printed on the second surface.

However, in the printing system of Document 1, since the web is loose between the two printers, needed are a mechanism for feeding the web while keeping it loosened and a mechanism for aligning the web with it loosened in the second printer, and the structure of the printing system becomes complicated.

Since feeding speeds in the two printers are adjustable individually in this printing system, the technique of Document 1 can not be employed in the case where feeding speeds in two printers are identical such as a printing system having a structure where the web is fed between the two printers at a constant tension. In the case where double side printing is performed by one printer, the technique of Document 1 can not be employed similarly since the printing speed is constant.

So, in printing images on the second surface of the web in Document 1, it is considered to employ a technique where printing of next image is started forcedly when detecting a start mark indicating the head of each page. According to this technique, it is possible that positions of images on the second surface are disposed at appropriate positions relative to images on the first surface in respective pages. Furthermore, by providing margins at tails (bottoms) of respective pages, missing of parts of images is prevented in the case where shrinkage of the web occurs.

However, in printing of an image continuing across pages (hereinafter, the image is referred to as a "continuous image"), if shrinkage of the web occurs, missing of parts of the continuous image arises at boundaries between pages since printing of each page is stopped forcedly. If expansion of the web occurs, blanks where the continuous image is not formed arise at boundaries between pages.

SUMMARY OF INVENTION

The present invention is intended for a printer for printing a continuous image on a web without a printing plate in accordance with a printed image formed on the web. It is an object of the present invention to print the continuous image in accordance with the printed image without being affected by expansion or shrinkage of the web.

The printer according to the present invention comprises: a printing mechanism for performing printing in synchronization with recording synchronization pulses; a mark detector for detecting pulse control marks on the web, the pulse control marks being provided at regular intervals in accordance with the printed image; and a pulse adjuster for obtaining a difference between the number of recording synchronization pulses inputted to the printing mechanism in a period and the number of recording synchronization pulses estimated to be inputted to the printing mechanism in the period, to adjust a frequency of recording synchronization pulses to be inputted to the printing mechanism on the basis of the difference, the period being from a detection of a preceding pulse control mark by the mark detector to a detection of a succeeding pulse control mark. In the present invention, it is possible to print the continuous image in accordance with the printed image without being affected by expansion or shrinkage of the web.

According to an aspect of the present invention, the continuous image is divided into unit images in a printing direction which have uniform lengths, and the pulse control marks are provided at positions corresponding to printing start positions of the unit images.

According to another aspect of the present invention, the web is fed from another apparatus located at the upstream of the printing mechanism, and a length of a portion of the web between the another apparatus and the printing mechanism is constant.

Preferably, the printing mechanism prints the continuous image on one surface of the web opposite to the other surface on which the printed image is formed.

The present invention is also intended for a printing system for printing an image on a web and the printing system comprises: a first printer for printing a first image on a web; and a second printer for printing a second image on the web without a printing plate, the second image being a continuous image, the web being fed from the first printer to the second printer; wherein the first printer prints pulse control marks on the web at regular intervals in accordance with the first image, a length of a portion of the web between the first printer and the second printer is constant, the second printer comprises: a printing mechanism for performing printing in synchronization with recording synchronization pulses; a mark detector for detecting the pulse control marks; and a pulse adjuster for obtaining a difference between the number of recording synchronization pulses inputted to the printing mechanism in a period and the number of recording synchronization pulses estimated to be inputted to the printing mechanism in the period, to adjust a frequency of recording synchronization pulses to be inputted to the printing mechanism on the basis of the difference, the period being from a detection of a preceding pulse control mark by the mark detector to a detection of a succeeding pulse control mark.

The present invention is also intended for a printing method of printing a continuous image on a web without a printing plate in accordance with a printed image formed on the web.

These and other objects, features, aspects and advantages of the present invention will become more apparent from the following detailed description of the present invention when taken in conjunction with the accompanying drawings.

DESCRIPTION OF EMBODIMENTS

Figure 1:
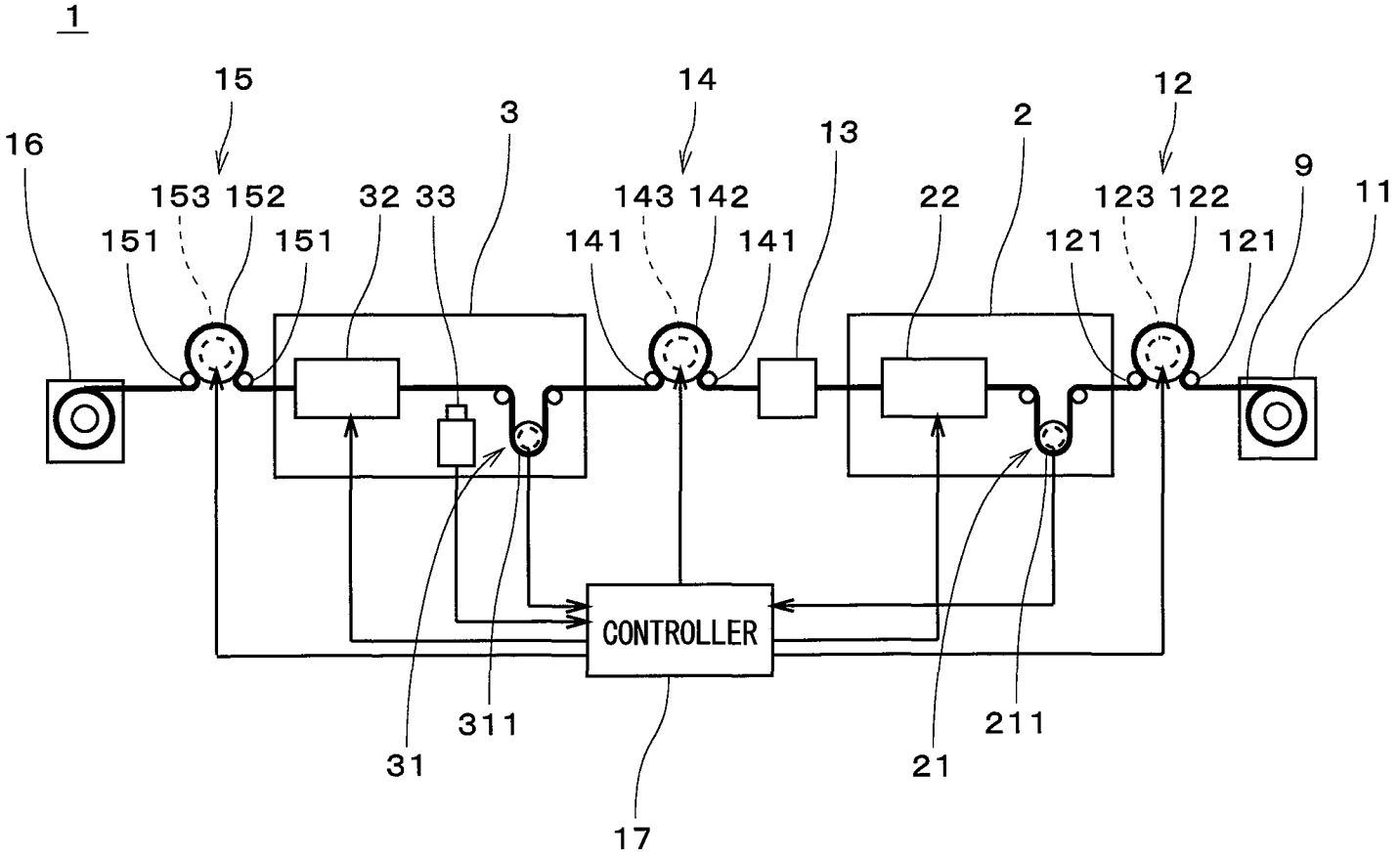
FIG. 1 is a view showing a printing system.

FIG. 1 is a view showing a printing system 1 in accordance with a preferred embodiment of the present invention. The printing system 1 prints images on both surfaces of a web 9 which is a band-like printing medium. For example, paper, resin film or thin metal plate is utilized as material of the web 9. The printing system 1 comprises a container 11 which storages the unprinted web 9 in the form of roll, a first motor part 12 for withdrawing (portions of) the web 9 from the container 11, a first printer 2 for printing an image on one surface of the web 9 (hereinafter, the surface is referred to as a "first surface" of the web 9) without a printing plate, and a turn bar 13 for turning over the web 9 upside down. The printing system 1 further comprises a second motor part 14 for withdrawing the web 9 from the first printer 2, a second printer 3 for printing an image on the other surface of the web 9 (hereinafter, the surface is referred to as a "second surface" of the web 9) without a printing plate, a third motor part 15 for withdrawing the web 9 from the second printer 3, a collecting part 16 for collecting the printed web 9 in the form of roll, and a controller 17 for controlling operation of the printing system 1. Each of the first motor part 12, the second motor part 14 and the third motor part 15 is pulse-driven by a motor driver.

In the following description, a direction from the right side of FIG. 1 toward the left side is referred to as a "feeding direction" of the web 9. A printing direction along which the image is sequentially printed on the web 9 by the first printer 2 located at the upstream side in the feeding direction and the second printer 3 located at the downstream side, is an opposite direction relative to the feeding direction. The image printed on the first surface of the web 9 by the first printer 2 is referred to as a "first image", and the image printed on the second surface of the web 9 by the second printer 3 is referred to as a "second image". Each of the first image and the second image is divided into unit images (hereinafter, the unit images and portions of the web corresponding to the unit images are referred to as "pages") in the printing direction which have uniform lengths. In the present embodiment, each of the first image and the second image is a continuous image where images continue seamlessly across pages (so-called gapless image). In the first printer 2, start marks indicating positions of respective pages are printed at the heads (tops) of the pages in accordance with the first image.

The first printer 2 comprises a first encoder 21 for detecting a feeding speed of the web 9 by rotation of a roller 211 which contacts the web 9, and a first inkjet printing mechanism 22 for ejecting ink onto the first surface of the web 9 to print the first image. The first printing mechanism 22 has a plurality of outlets arranged in a direction perpendicular to the feeding direction and perpendicular to the sheet of FIG. 1 (hereinafter, the direction is referred to as a "width direction").

Though actually the first printing mechanism 22 has a structure where a plurality of rows each having a plurality of outlets arranged in the width direction are arranged in the feeding direction, it is supposed in the present embodiment that the first printing mechanism 22 has only one row of the plurality of outlets in order to simplify the following discussion (the same applies to a second printing mechanism 32). Hereinafter, a row of recorded dots (or a row of positions where dots are to be recorded) arranged in the width direction at each position in the printing direction of the web 9 is referred to as a "recording line". The web 9 in the first printing mechanism 22 is positioned on a plurality of rollers arranged in the feeding direction to be horizontalized.

The second printer 3 comprises a second encoder 31 for detecting a feeding speed of the web 9 by rotation of a roller 311 which contacts the web 9, a second inkjet printing mechanism 32 for ejecting ink onto the second surface of the web 9 fed from the first printer 2 to print the second image, and a mark detector 33 for detecting the start marks. The web 9 in the second printing mechanism 32 is positioned on a plurality of rollers arranged in the feeding direction to be horizontalized.

The first motor part 12 comprises an infeed roller 122 for feeding the web 9 wound on its outer peripheral surface by auxiliary rollers 121, and a motor 123 for rotating the infeed roller 122. In the same manners as the first motor part 12, the second motor part 14 comprises an intermediate roller 142 for feeding the web 9 wound on its outer peripheral surface by auxiliary rollers 141, and a motor 143 for rotating the intermediate roller 142, and the third motor part 15 comprises an outfeed roller 152 for feeding the web 9 wound thereon by auxiliary rollers 151, and a motor 153 for rotating the outfeed roller 152.

In the printing system 1, rotation speeds of the first motor part 12, the second motor part 14 and the third motor part 15 are adjusted in the controller 17 on the basis of the feeding speeds of the web 9 obtained by the first encoder 21 and the second encoder 31 and a tension of the web 9 detected by a not-shown tension detecting mechanism, and therefore a tension and a length of a portion of the web 9 between the first printer 2 (or the first printing mechanism 22) and the second printer 3 (or the second printing mechanism 32) are kept constant.

Figure 2:
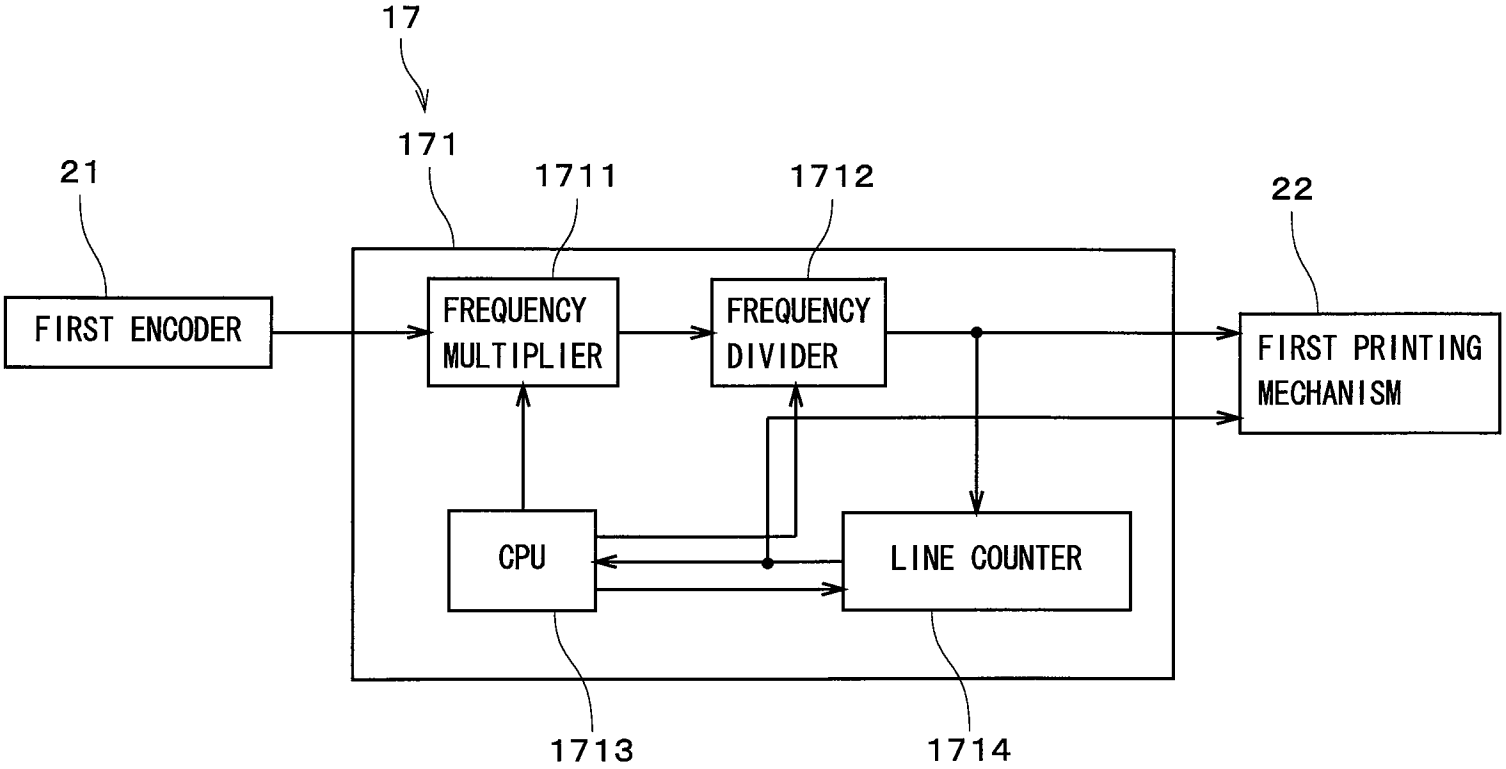
FIG. 2 is a block diagram showing a constitution of first pulse generator.
Figure 3:
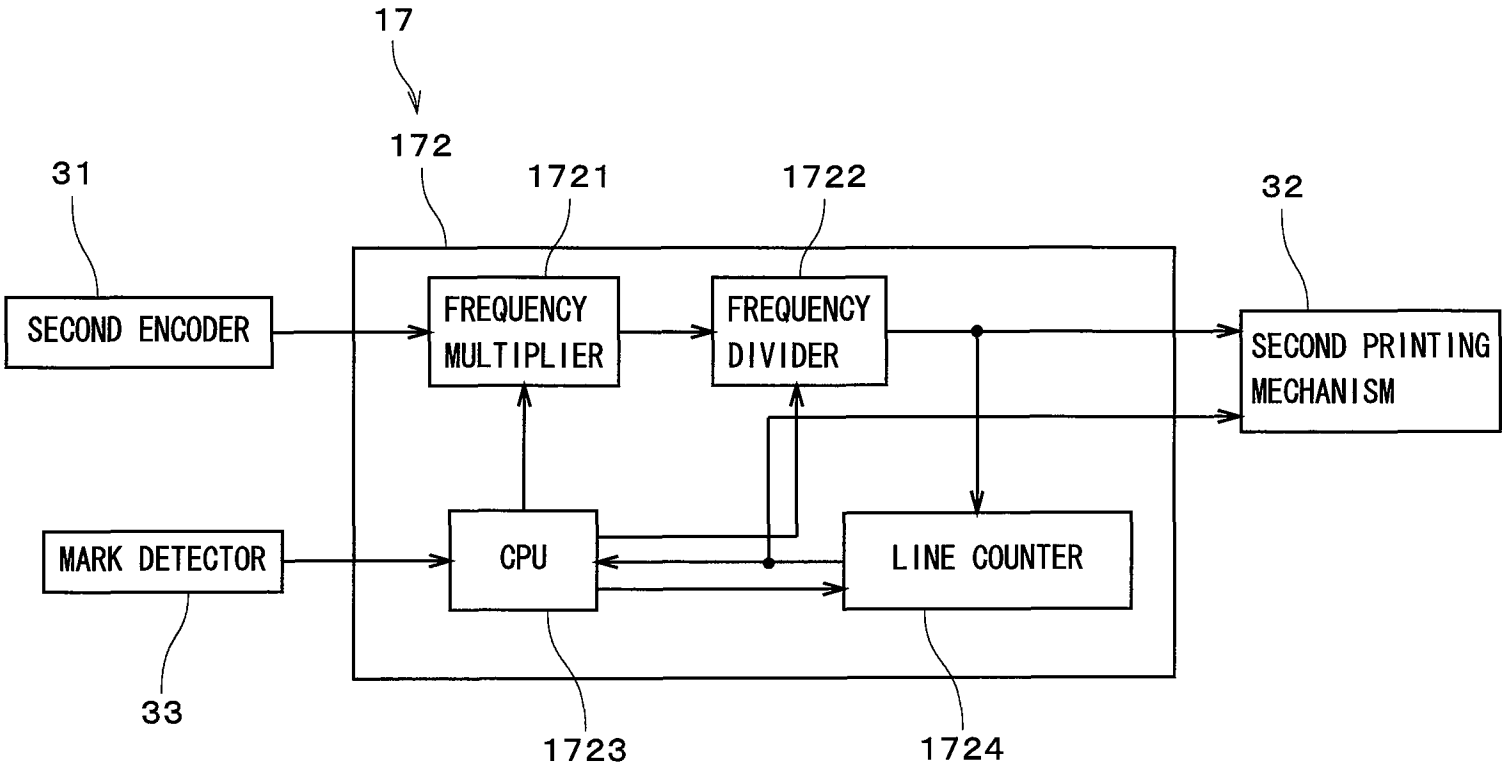
FIG. 3 is a block diagram showing a constitution of second pulse generator.

FIGS. 2 and 3 are block diagrams showing parts of functional constitution of the controller 17, respectively. In the controller 17, recording synchronization pulses which indicate to record (form) dots to recording lines for the first printing mechanism 22 and the second printing mechanism 32 are generated by the parts of functional constitution shown in FIGS. 2 and 3. Hereinafter, the parts of functional constitution shown in FIGS. 2 and 3 are referred to as a "first pulse generator 171" and a "second pulse generator 172" of the controller 17, respectively.

As shown in FIG. 2, the first pulse generator 171 comprises a frequency multiplier (multiplying circuit) 1711 for multiplying a frequency of signals inputted from the first encoder 21, a frequency divider (dividing circuit) 1712 for dividing a frequency of signals inputted from the frequency multiplier 1711, a CPU 1713 for setting a multiplying ratio of the frequency multiplier 1711 and a dividing ratio of the frequency divider 1712, and a line counter 1714 for counting the number of generation of recording synchronization pulses. In the first pulse generator 171, recording synchronization pulses with a certain frequency are generated by the frequency multiplier 1711 and the frequency divider 1712 on the basis of the signals inputted from the first encoder 21, and the recording synchronization pulses are outputted to the first printing mechanism 22 and the line counter 1714. The frequency of recording synchronization pulses is the number obtained by multiplying the frequency of signals inputted from the first encoder 21 by M/N where the multiplying ratio of the frequency multiplier 1711 is M, the dividing ratio of the frequency divider 1712 is N, and M and N are positive integers.

As shown in FIG. 3, the second pulse generator 172 has a similar constitution to the first pulse generator 171 and comprises a frequency multiplier 1721 for multiplying a frequency of signals inputted from the second encoder 31 by a positive integer, a frequency divider 1722 for dividing a frequency of signals inputted from the frequency multiplier 1721 by a positive integer, a CPU 1723 for setting a multiplying ratio of the frequency multiplier 1721 and a dividing ratio of the frequency divider 1722, and a line counter 1724 for counting the number of generation of recording synchronization pulses. In the second pulse generator 172, recording synchronization pulses generated through the frequency multiplier 1721 and the frequency divider 1722 are outputted to the second printing mechanism 32 and the line counter 1724, and a frequency of recording synchronization pulses is changed for every page of the web 9 as described later.

There may be a case where the first pulse generator 171 is provided as a part of the first printer 2 and the second pulse generator 172 is provided as a part of the second printer 3.

Figure 4:
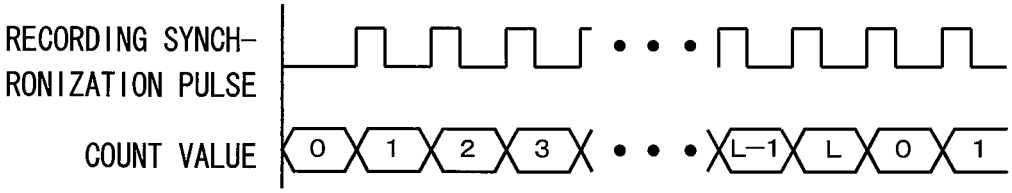
FIG. 4 is a view showing recording synchronization pulses and count values in a line counter.

FIG. 4 is a view showing recording synchronization pulses generated by the first pulse generator 171 and count values in the line counter 1714. "1" is sequentially added to the count value in the line counter 1714 every time when a recording synchronization pulse is inputted thereto. A part of data of the first image is sent to a memory in the first printing mechanism 22 from an upper system of the first printing mechanism 22 and image data of several pages is stored therein temporarily (the same applies to the second printing mechanism 32). In the first printing mechanism 22, data representing a part of the first image which corresponds to the count value is sequentially read out from the memory, and recording (i.e., formation of dots) for one line is performed on a recording line of the web 9 in synchronization with an inputted recording synchronization pulse (actually, recording is repeated for respective recording lines). In the following description, data corresponding to one recording line is referred to as "line data" (the same applies to the second image). The count value indicates an ordinal number of each recording line in one page.

When the count value shown in FIG. 4 becomes equal to the number L of recording lines included in one page, a reset signal generated in the CPU 1713 is outputted to the line counter 1714 to reset the count value (i.e., the count value becomes "0"). The reset signal is also outputted to a not-shown page counter and "1" is added to a count value corresponding to the page number.

Figure 5:
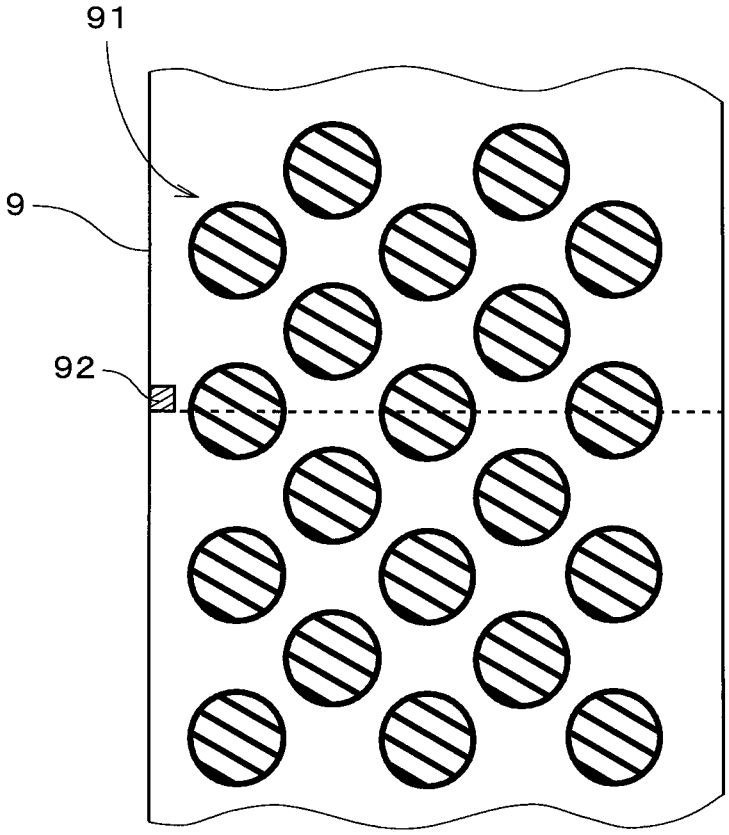
FIG. 5 is a view showing an example of first image.

FIG. 5 is a view showing an example of a part of the first image 91 printed by the first printing mechanism 22 and a boundary line between pages is indicated by a dotted line. In FIG. 5, a direction from the upper side toward the lower side corresponds to the feeding direction (the same applies to FIG. 6). The first image 91 is printed on the first surface of the web 9 across the boundaries between pages and the start marks 92 are printed at positions corresponding to the heads of respective pages which are printing start positions of the pages. In the first printing mechanism 22, since printing is performed in synchronization with recording synchronization pulses generated on the basis of signals inputted from the first encoder 21, the first image is prevented from being deformed in the feeding direction even if the feeding speed fluctuates slightly.

In the line counter 1724 of the second pulse generator 172 shown in FIG. 3, "1" is sequentially added to the count value every time when a recording synchronization pulse is inputted thereto, in the same fashion as the case shown in FIG. 4. In the second printing mechanism 32, the line data corresponding to the count value is sequentially read out from the memory, and recording for one line is performed on each recording line of the web 9 in synchronization with a recording synchronization pulse. Also in the second pulse generator 172, the count value indicates an ordinal number of each recording line in one page.

When the count value becomes equal to the number L of recording lines included in one page, a reset signal generated in the CPU 1723 is outputted to the line counter 1724 to reset the count value to "0". The reset signal is also outputted to a not-shown page counter and "1" is added to a count value corresponding to the page number.

Figure 6:
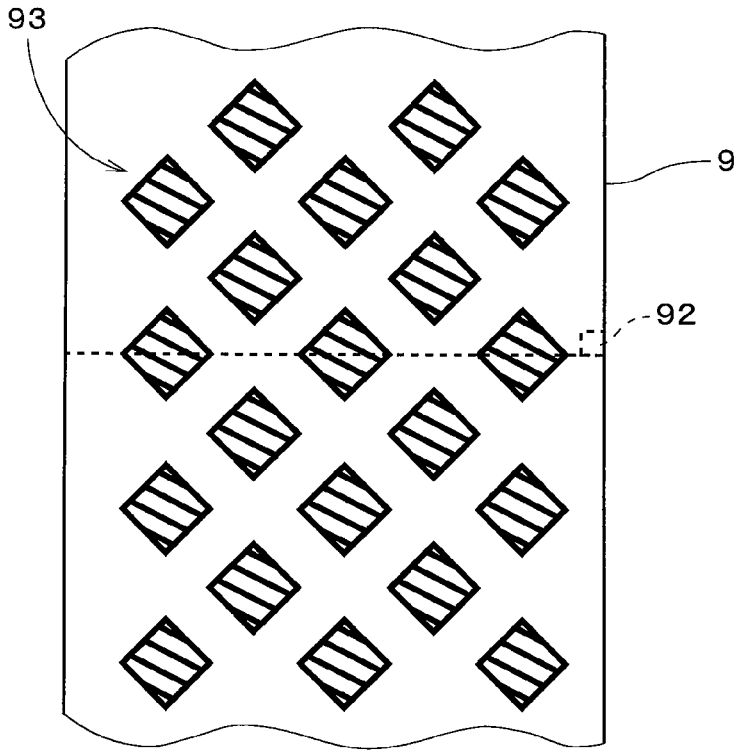
FIG. 6 is a view showing an example of second image.

FIG. 6 is a view showing an example of the second image 93 printed by the second printing mechanism 32 and the boundary line between pages and the start mark 92 are indicated by dotted lines. On the second surface of the web 9, that is the surface opposite to the first image 91 of FIG. 5, the second image 93 is printed across the boundaries between pages. In the second printing mechanism 32, since printing is performed in synchronization with recording synchronization pulses generated on the basis of signals inputted from the second encoder 31, the second image is prevented from being deformed in the feeding direction even if the feeding speed fluctuates slightly.

Figure 7:
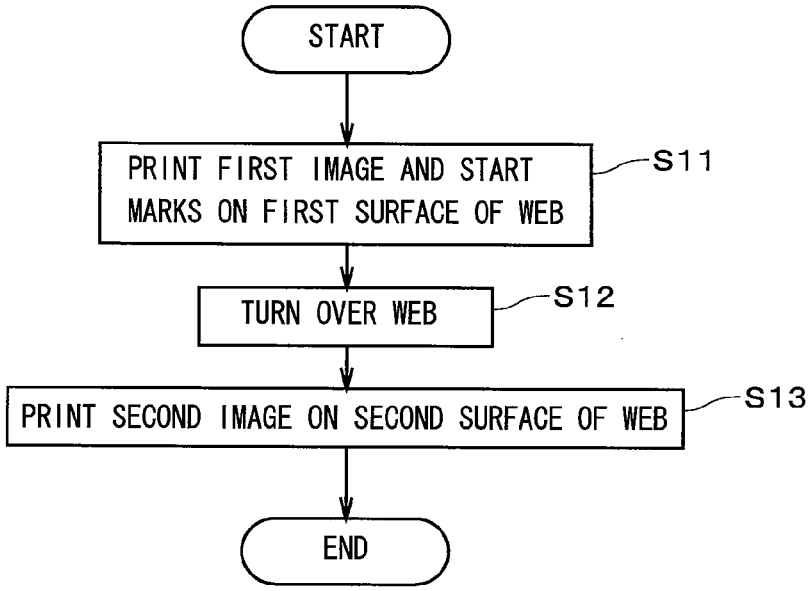
FIG. 7 is a flowchart showing an operation flow for printing on a web.

FIG. 7 is a flowchart showing an operation flow for printing an image on the web 9 by the printing system 1. FIG. 7 shows the operation flow with focus on printing of parts of the first image and the second image, and actual Steps S11 to S13 are performed in parallel. In preliminary work of printing, a portion of the web 9 is withdrawn from the container 11 shown in FIG. 1 and (the end portion of) the web 9 is connected (attached) to a winding shaft in the collecting part 16 through the first motor part 12, the first printer 2, the turn bar 13, the second motor part 14, the second printer 3 and the third motor part 15.

In printing, the first motor part 12, the second motor part 14 and the third motor part 15 are rotated to feed the web 9 in the feeding direction. The feeding speed of the web 9 in the first printer 2 is detected by the first encoder 21 and recording synchronization pulses with a certain frequency are generated by the frequency multiplier 1711 and the frequency divider 1712 of the controller 17 shown in FIG. 2 on the basis of the signals inputted from the first encoder 21. The first image and the start marks at respective pages are printed on the first surface of the web 9 by the first printing mechanism 22 in synchronization with the recording synchronization pulses (Step S11).

In detail, line data of the head of the first page corresponding to the count value "0" which is the initial value, is read out first in the first printing mechanism 22. Then a recording synchronization pulse is inputted thereto and recording of one line is performed on the corresponding recording line. Line data of several lines from the head contains the start mark. Also the count value is changed (updated) from "0" to "1", line data corresponding to the count value "1" is read out and recording is performed on next recording line in synchronization with a recording synchronization pulse. Furthermore, the count value is incremented from "1" to "2" and then recording is performed on next recording line.

As above, in the first printing mechanism 22 shown in FIG. 2, every time when the count value is changed, line data corresponding to the count value is sequentially read out, and by input of a recording synchronization pulse, recording of one line is performed on every recording line in synchronization with the recording synchronization pulse. By the above operation, an image of the first page on the first surface of the web 9 and the start mark are printed. In the following description, a part of the first image which is printed on each page is referred to as a "page image" (the same applies to the second image).

When recording onto a line positioned at the tail (bottom) of the first page is completed, the count value in the line counter 1714 becomes equal to the number L of recording lines included in one page and therefore the reset signal generated in the CPU 1713 is inputted to the line counter 1714 to reset the count value to "0". On every page subsequent to the first page (i.e., the second page and later), a page image is printed and the reset signal is inputted to the line counter 1714 at the tail of the page to reset the count value to "0", in the same way as the first page.

On the other hand, each page on which (a part of) the first image has been printed is turned over by the turn bar 13 shown in FIG. 1 (Step S12), and it is fed into the second printer 3.

In the second printer 3, the feeding speed of the web 9 is detected by the second encoder 31 and recording synchronization pulses are generated by the frequency multiplier 1721 and the frequency divider 1722 of the controller 17 shown in FIG. 3 on the basis of the signals inputted from the second encoder 31. The second image is printed on the second surface of the web 9 by the second printing mechanism 32 in synchronization with the recording synchronization pulses (Step S13).

In detail, in the second printing mechanism 32, when the start mark printed at the head of the first page is detected by the mark detector 33, line data corresponding to the count value "0" which is the initial value is read out. And recording of one line is performed on a recording line positioned at the head of the first page in synchronization with a recording synchronization pulse in the same way as the first printing mechanism 22. Since the second printing mechanism 32 is slightly away from the mark detector 33 actually, delay processing after detection of the start mark is performed to adjust a position at the head of the first page to the second printing mechanism 32.

Also the count value is changed to "1", line data corresponding to the count value "1" is read out and recording is performed on next recording line in synchronization with a recording synchronization pulse. As above, also in the second printing mechanism 32, every time when the count value is changed, line data corresponding to the count value is sequentially read out, and by input of a recording synchronization pulse, recording of one line is performed on every recording line in synchronization with the recording synchronization pulse. By the above operation, a page image of the first page is printed on the second surface of the web 9.

In the second printing mechanism 32, when recording onto a line positioned at the tail of the first page is completed, the count value in the line counter 1724 becomes equal to the number L of recording lines included in one page and therefore the reset signal generated in the CPU 1723 is inputted to the line counter 1724 to reset the count value to "0". On the other hand, next start mark is detected by the mark detector 33 before recording onto the line at the tail of the first page, and a frequency of recording synchronization pulses is changed by the technique described later. Then a page image is printed on the second page in the same way as the first page. After that, every time when the start mark is detected by the mark detector 33, the frequency of recording synchronization pulses is changed and a page image is printed on next page.

Figure 8:
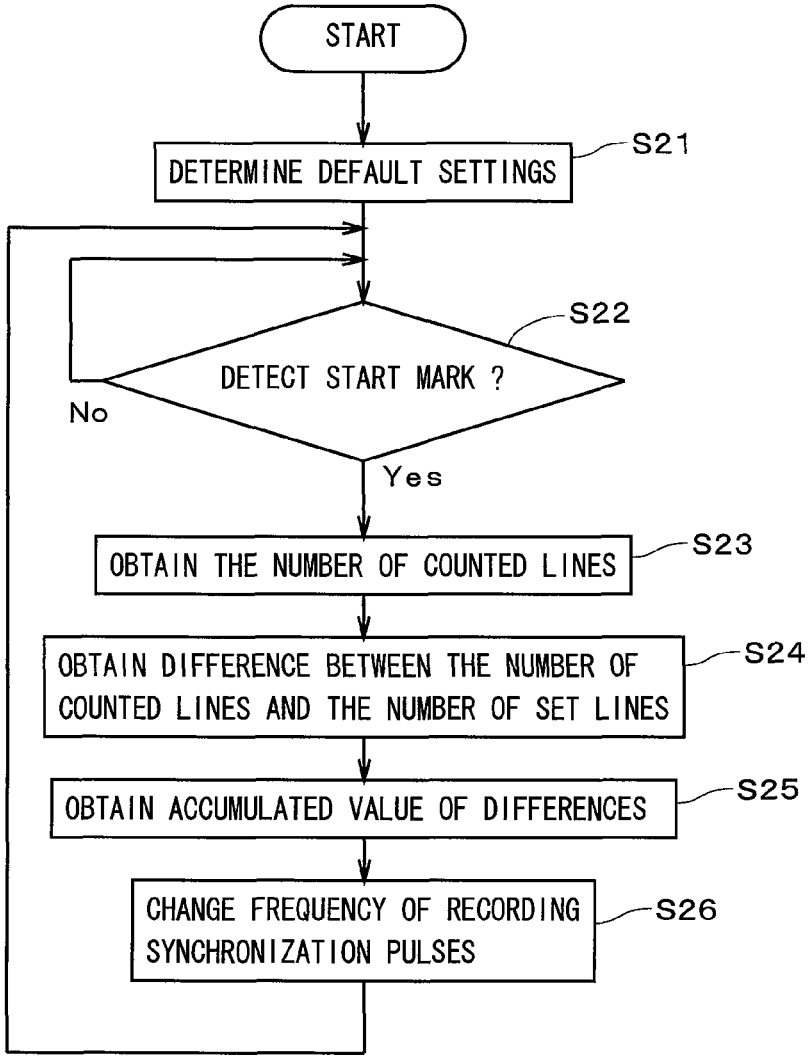
FIG. 8 is a flowchart showing an operation flow for adjusting a frequency of recording synchronization pulses.

FIG. 8 is a flowchart showing an operation flow for adjusting the frequency of recording synchronization pulses inputted to the second printing mechanism 32 and the end of the process in FIG. 8 is not shown (omitted). In the following description, "adjustment of frequency" means iterations of changing the frequency (changing the frequency many times) in order to perform appropriate printing. Hereinafter, a page to which changed recording synchronization pulses (recording synchronization pulses whose frequency has been changed) are used, is referred to as a "target page" and a page just before the target page (i.e., a page adjacent to the target page) is referred to as a "preceding page". Adjustment of frequency of recording synchronization pulses is performed by changing the multiplying ratio of the frequency multiplier 1721 by using PI control in the CPU 1723 shown in FIG. 3.

First, the number of recording lines set in one page (hereinafter, the number is referred to as "the number of set lines"), an initial frequency of recording synchronization pulses, and the proportional gain and the integral gain in the PI control are determined as default settings (Step S21). Next, when the start mark and the first page of the first image which are printed by the first printer 2 shown in FIG. 1 are fed into the second printer 3, the start mark printed at the first page is detected by the mark detector 33 (Step S22). Therefore, the line counter 1724 starts to count recording synchronization pulses. The first page of the second image is recorded (formed) at the default frequency of recording synchronization pulses and Steps S23 to S26 are not performed.

Subsequently, the second page of the first image is fed into the second printer 3 and the start mark printed at the second page is detected by the mark detector 33 (Step S22). Therefore, by the line counter 1724, obtained is the number of recording synchronization pulses inputted to the second printing mechanism 32 in a period from the detection of the start mark printed at the first page which is the preceding page, to the detection of the start mark printed at the second page which is the target page (i.e., the period between the two detection) (Step S23). Hereinafter, the number is referred to as "the number of counted lines". And a difference between the number of counted lines and the number of set lines is obtained by the CPU 1723 (Step S24). An accumulated value of the differences is also obtained (Step S25), although only one difference has been calculated at the time point when printing of the first page is completed.

Here, the multiplying ratio M' of the frequency multiplier 1721 to determine the frequency of recording synchronization pulses for the target page, is calculated by Eq. 1 where the proportional gain is $K_P$, the integral gain is $K_I$ ($K_P$, $K_I$ are positive real numbers), the number of set lines is L, the difference between the number of counted lines and the number of set lines L in the preceding page is ΔL (i.e., (the number of counted lines)−(the number of set lines)), the sum of the differences between the number of counted lines and the number of set lines L which are obtained in all pages before the target page (i.e., the sum is the accumulated value) is ΣΔ Ln, and the multiplying ratio of the frequency multiplier 1721 for the preceding page is M. The multiplying ratio M' calculated for the target page is outputted to the frequency multiplier 1721 and the frequency of recording synchronization pulses is changed (Step S26).

$$M'=M+K_P\Delta L+K_I\Sigma\Delta\ \mathrm{Ln} \quad \text{(Eq. 1)}$$

Then, after the third page of the first image is fed into the second printer 3 and the start mark is detected by the mark detector 33 (Step S22), by the line counter 1724 obtained is the number of counted lines which is the number of recording synchronization pulses inputted to the second printing mechanism 32 in the period from the detection of start mark at the second page which is the preceding page, to the detection of start mark at the third page which is the target page (Step S23). In the CPU 1723, the difference between the number of counted lines and the number of set lines is obtained (Step S24), and also the accumulated value of the differences is obtained (Step S25). The multiplying ratio is calculated by using Eq. 1 and inputted to the frequency multiplier 1721, and the frequency of recording synchronization pulses is changed to a value to apply to the third page (Step S26).

After that, Steps S23 to S26 are performed every time when the start mark at each page is detected, and therefore feedback control is performed so that the number of recording lines in printing of one page comes close to (or becomes equal to) the number of set lines.

As above, in the printing system 1, the second pulse generator 172 serves as a pulse adjuster for adjusting the frequency of recording synchronization pulses and the start marks serve as pulse control marks used for adjustment of the frequency of recording synchronization pulses.

Figure 9:
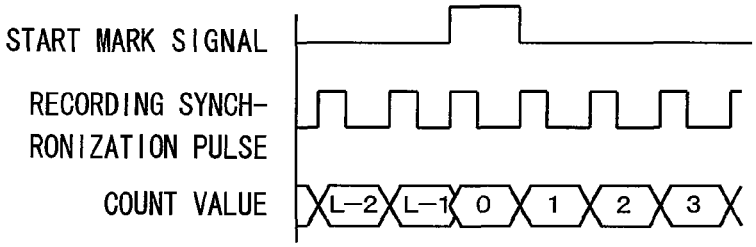
FIG. 9 is a view showing a start mark signal, recording synchronization pulses and count values of a comparative example.
Figure 10:
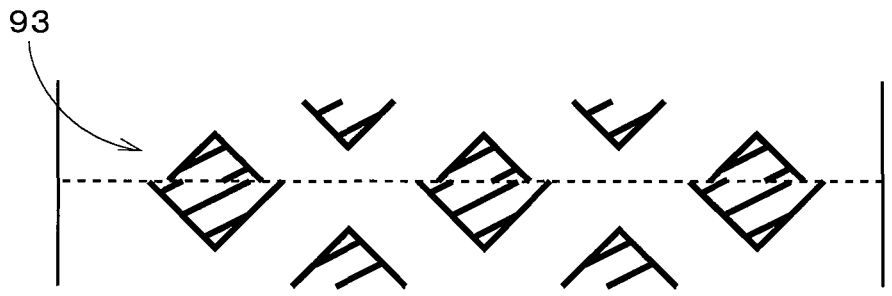
FIG. 10 is a view showing a second image of the comparative example.

In the printing system 1 shown in FIG. 1, there is a case where expansion or shrinkage of the web occurs due to drying of ink on the web 9 in the first printer 2, fluctuations in the tension of the web 9, the difference of feeding speeds between the first printer 2 and the second printer 3 because of slip of the web 9 in each motor part 12, 14, 15 and so on. Especially in the case where shrinkage of the web 9 occurs, if the frequency of recording synchronization pulses is consistently made to be constant as exemplified in FIG. 9 showing a comparative example, the number of lines actually recorded in one page decreases from L to (L−1) and missing of a part corresponding to the count value L arises at a boundary between pages in the second image 93 as shown in FIG. 10.

Figure 11:
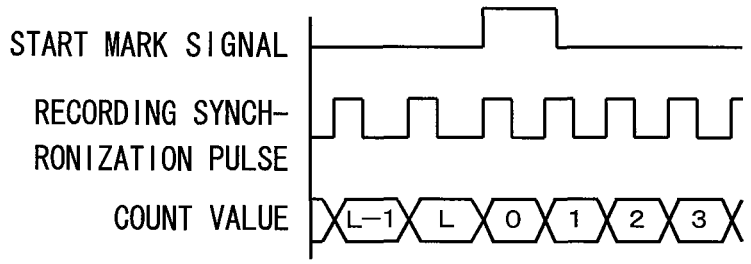
FIG. 11 is a view showing a start mark signal, recording synchronization pulses and count values.

Correspondingly, in the second printer 3, the multiplying ratio is made to be larger in the case where shrinkage of the web 9 occurs, and when a signal indicating the detection of start mark at the target page is inputted to the CPU 1723 (see FIG. 3) as shown in FIG. 11, the frequency of recording synchronization pulses is made to be higher (Step S26). Therefore, intervals of recording lines in the target page become smaller to prevent decrease of recording lines, and the part corresponding to the count value L can be recorded appropriately.

Figure 12:
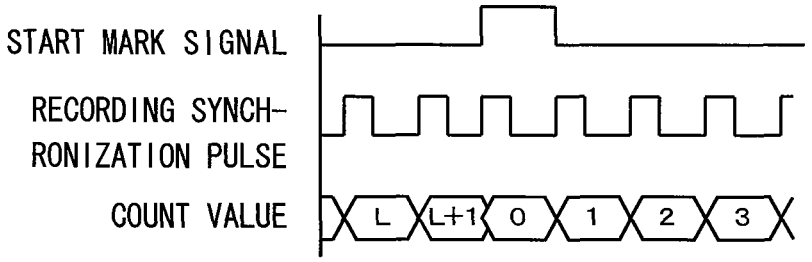
FIG. 12 is a view showing a start mark signal, recording synchronization pulses and count values of another comparative example.
Figure 13:
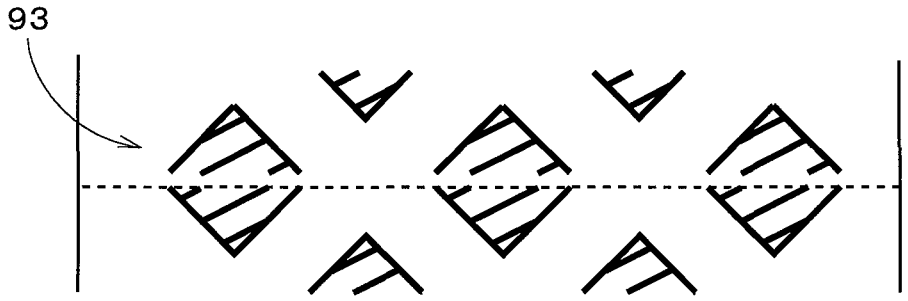
FIG. 13 is a view showing a second image of the another comparative example.

On the other hand, in the case where expansion of the web 9 occurs, if the frequency of recording synchronization pulses is consistently made to be constant as exemplified in FIG. 12 showing another comparative example, the number of lines actually recorded in one page increases from L to (L+1). Since there is no line data corresponding to the count value (L+1), a blank arises at the boundary between pages in the second image 93 as shown in FIG. 13.

Figure 14:
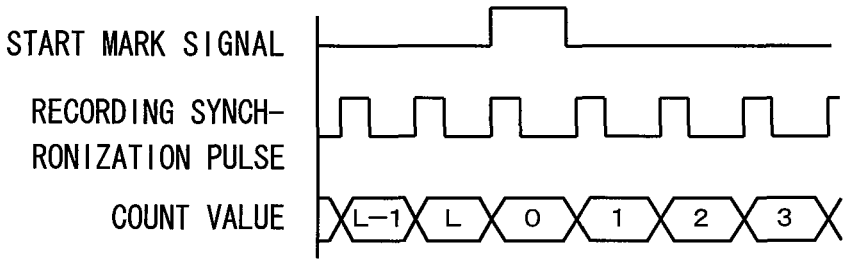
FIG. 14 is a view showing a start mark signal, recording synchronization pulses and count values.

Correspondingly, in the preferred embodiment, the multiplying ratio is made to be smaller, and when the signal indicating the detection of start mark at the target page is inputted to the CPU 1723 (see FIG. 3) as shown in FIG. 14, the frequency of recording synchronization pulses is made to be lower (Step S26). Therefore, intervals of recording lines become larger to prevent increase of recording lines, and occurrence of a blank in the second image 93 can be prevented.

As described above, in the printing system 1, obtained is the difference between the number of recording synchronization pulses actually inputted to the second printing mechanism 32 in a period and the number of recording synchronization pulses estimated to be inputted to the second printing mechanism 32 in the period (i.e., the difference between the number of counted lines and the number of set lines), to adjust the frequency of recording synchronization pulses on the basis of the difference, where the period is from a detection of a preceding start mark by the mark detector 33 to a detection of a succeeding start mark (Steps S22 to S26). Therefore, occurrence of missing or blanks in the second image due to expansion or shrinkage of the web 9 is prevented, and the second printer 3 can print the second image appropriately in accordance with the printed first image without being affected by expansion or shrinkage of the web 9.

In the second printer 3, since appropriate printing of the second image can be performed independently of the feeding speed of the web 9, it is preferred that adjustment of the frequency of recording synchronization pulses shown in FIG. 8 is used for a printing system such as the printing system 1 where a length of a portion of the web 9 between the printer 2 and the printer 3 is made to be constant (i.e., the web 9 is tensioned between the printers) and the printing speed in the second printer 3 depends on the printing speed in the first printer 2.

Though the preferred embodiments of the present invention have been discussed above, the present invention is not limited to the above-discussed preferred embodiments, but allows various variations.

In the above preferred embodiments, since the start marks serves as pulse control marks to control the frequency of recording synchronization pulses in the second printer 3, pulse control marks need not be provided differently from the start marks. However, for example, pulse control marks which do not indicate boundaries between pages may be printed at regular intervals on the web 9 by the first printer 2 as substitute for the start marks or in addition to the start marks. Pulse control marks are provided at positions associated with content of the printed image. Pulse control marks are not limited to objects purposely provided as marks, and printed letters, patterns, lines and the like may be used as the pulse control marks. Furthermore, holes provided on the web 9 at regular intervals may be used as the pulse control marks.

Though the multiplying ratio of the frequency multiplier 1721 is changed to adjust the frequency of recording synchronization pulses in the above preferred embodiments, there may be a case where the dividing ratio of the frequency divider 1722 is changed or both the multiplying ratio and the dividing ratio are changed. The first pulse generator 171 and the second pulse generator 172 may be provided in the first printer 2 and the second printer 3, respectively. As long as the frequency of recording synchronization pulses is adjusted on the basis of the difference between the number of recording synchronization pulses which has been inputted to the printing mechanism and the number of recording synchronization pulses which is estimated (or set in advance) to be inputted to the printing mechanism, various feedback controls other than PI control, such as PID control may be used in the above preferred embodiments.

In the printing system 1, there may be a case where both the first image and the second image are printed on one surface of the web 9 or the first image is a discontinuous image where pages are separated from one another.

The technique of adjusting the frequency of recording synchronization pulses can be applied to a printer which performs double side printing by itself. And also the technique can be applied to a printing system where the web is fed between printers with it loosened.

In the above preferred embodiments, the discussion has been made on the premise that the number of counted lines which is the number of recording synchronization pulses used for recording of the preceding page is obtained at the time point when the start mark of the target page is detected in the second printer 3. However, actually it is not necessarily the case that the number of recording synchronization pulses inputted to the second printer 3 in a period between detections of two start marks is identical to the number of recording synchronization pulses used for recording of the preceding page. In this regard, however, since feedback control is performed in the second printer 3, it is possible to print the second image appropriately even if the number of counted lines is not identical to the number of recording synchronization pulses used for the preceding page.

On the contrary, the definite number of recording synchronization pulses which should be certainly used for recording of the preceding page may be used as the number of counted lines, and in this case, the number of counted lines is identical to the actual number of recording synchronization pulses used for the recording of the preceding page. As above, the number of recording synchronization pulses which is inputted to the printing mechanism in a period between the detection of start mark of the preceding page and the detection of start mark of the target page and which is used for control of the frequency of recording synchronization pulses may be commuted to the number of recording synchronization pulses which should be certainly inputted, as long as it is equivalent to the above. Furthermore, it is not necessarily the case that the number of counted lines in the preceding page adjacent to the target page is used for control of recording synchronization pulses in the target page, and only the number of counted lines in the further preceding page (i.e., the page prior to the preceding page) may be used.

There may be a case where the first printer 2 and the second printer 3 are other printers each performing plateless printing such as electrophotographic printers or the first printer 2 is a printer (printing apparatus) which performs printing with a printing plate. Furthermore, there may be a case where the first printer 2 is omitted in the printing system 1 and from a roll of the web 9 where the first image and the pulse control marks has been printed, the web 9 is directly fed into the second printer 3. The technique of adjusting the frequency of recording synchronization pulses can be applied to a printing system having three or more printers.

While the invention has been shown and described in detail, the foregoing description is in all aspects illustrative and not restrictive. It is therefore understood that numerous modifications and variations can be devised without departing from the scope of the invention. This application claims priority benefit under 35 U.S.C. Section 119 of Japanese Patent Application No. 2009-79814 filed in the Japan Patent Office on Mar. 27, 2009, the entire disclosure of which is incorporated herein by reference.

REFERENCE SIGNS LIST

1 printing system
2 first printer
3 second printer
9 web
32 second printing mechanism
33 mark detector
91 first image
92 start mark
93 second image
172 second pulse generator
S22, S24, S26 step

The invention claimed is:

1. A printing system for printing an image on a web, comprising:

a first printer for printing a first image on a web; and a second printer which is an inkjet printer for printing a second image on said web, said second image being a continuous image and being divided into unit images in a printing direction which have uniform lengths, said web being fed from said first printer to said second printer; wherein said first printer prints pulse control marks on said web at regular intervals in accordance with said first image, said pulse control marks being provided at positions corresponding to printing start positions of said unit images and providing printing start positions of said second image in said second printer, said second printer comprises:

a printing mechanism for performing printing in synchronization with recording synchronization pulses, said printing mechanism recording one recording line at a corresponding position in said printing direction on said web in synchronization with a recording synchronization pulse, said recording line being a row of recorded dots arranged in a width direction perpendicular to said printing direction, said recording synchronization pulses each being generated for recording of one recording line of said second image and being generated on the basis of a feeding speed of said web;

a mark detector of said second printer for detecting said pulse control marks; and a pulse generator of said second printer for generating said recording synchronization pulses, and for obtaining a difference between the number of recording synchronization pulses inputted to said printing mechanism in a period and an estimated number of recording synchronization pulses estimated to be inputted to said printing mechanism in said period, and on the basis of said difference, to adjust a frequency of recording synchronization pulses to be inputted to said printing mechanism, for every unit image, wherein said frequency of said recording synchronization pulses is made higher in order to decrease intervals of recording lines of said second image and said frequency of said recording synchronization pulses is made lower in order to increase intervals of recording lines of said second image, said period being from a detection of a preceding pulse control mark by said mark detector to a detection of a succeeding pulse control mark, said pulse generator causing said printing mechanism to start printing of a unit image with adjusted recording synchronization pulses every time when a pulse control mark is detected by said mark detector; and a length of a portion of said web between a printing mechanism in said first printer and said printing mechanism in said second printer is constant.

2. The printing system according to claim 1, wherein said first printer prints said first image on one surface of said web, and said second printer prints said second image on the other surface of said web.

3. The printing system according to claim 1, wherein said second printer further comprises an encoder for detecting a feeding speed of said web, and said pulse generator in said second printer generates said recording synchronization pulses with a frequency multiplier and a frequency divider on the basis of signals inputted from said encoder, to change intervals of recording lines of said second image.

4. A printing method of printing an image on a web, comprising the steps of:

a) printing a first image on a web by a first printer;

b) printing a second image on said web by a second printer which is an inkjet printer, said second image being a continuous image and being divided into unit images in a printing direction which have uniform lengths, said web being fed from said first printer to said second printer; wherein in said step a), pulse control marks are printed on said web at regular intervals in accordance with said first image, said pulse control marks being provided at positions corresponding to printing start positions of said unit images and providing printing start positions of said second image in said second printer, said second printer comprises a printing mechanism for performing printing in synchronization with recording synchronization pulses, said printing mechanism recording one recording line at a corresponding position in said printing direction on said web in synchronization with a recording synchronization pulse, said recording line being a row of recorded dots arranged in a width direction perpendicular to said printing direction, said recording synchronization pulses each being generated for recording of one recording line of said second image and being generated on the basis of a feeding speed of said web, in said step b), said recording synchronization pulses are generated, a difference between the number of recording synchronization pulses inputted to said printing mechanism in a period and an estimated number of recording synchronization pulses estimated to be inputted to said printing mechanism in said period is obtained, and on the basis of said difference, to adjust a frequency of recording synchronization pulses to be inputted to said printing mechanism, for every unit image, wherein said frequency of said recording synchronization pulses is made higher in order to decrease intervals of recording lines of said second image and said frequency of said recording synchronization pulses is made lower in order to increase intervals of recording lines of said second image, said period being from a detection of a preceding pulse control mark by a mark detector to a detection of a succeeding pulse control mark, and said printing mechanism starts printing of a unit image with adjusted recording synchronization pulses every time when a pulse control mark is detected by said mark detector, and a length of a portion of said web between a printing mechanism in said first printer and said printing mechanism in said second printer is constant.

5. The printing method according to claim 4, wherein said first printer prints said first image on one surface of said web, and said second printer prints said second image on of said web.

6. The printing method according to claim 4, wherein said second printer further comprises an encoder for detecting a feeding speed of said web, and in said step b), said recording synchronization pulses are generated with a frequency multiplier and a frequency divider on the basis of signals inputted from said encoder, to change intervals of recording lines of said second image.

* * * * *